US008179282B1

(12) United States Patent
MacCarley

(10) Patent No.: US 8,179,282 B1
(45) Date of Patent: May 15, 2012

(54) CONSENSUS BASED VEHICLE DETECTOR VERIFICATION SYSTEM

(75) Inventor: Carl Arthur MacCarley, Nipomo, CA (US)

(73) Assignee: Cal Poly Corporation, San Luis Obispo, CA (US)

( * ) Notice: Subject to any disclaimer, the term of this patent is extended or adjusted under 35 U.S.C. 154(b) by 1201 days.

(21) Appl. No.: 11/948,916

(22) Filed: Nov. 30, 2007

(51) Int. Cl.
*G08G 1/01* (2006.01)

(52) U.S. Cl. ..... 340/933; 340/937; 340/941; 340/514; 701/119

(58) Field of Classification Search ..... 340/933–943, 340/928, 514; 701/117–119; 324/243, 654
See application file for complete search history.

(56) References Cited

U.S. PATENT DOCUMENTS

| | | | | |
|---|---|---|---|---|
| 7,440,823 | B2 * | 10/2008 | Yamamura et al. | 701/1 |
| 2005/0110658 | A1 * | 5/2005 | Lu et al. | 340/941 |
| 2007/0252728 | A1 * | 11/2007 | Wisherd et al. | 340/933 |

OTHER PUBLICATIONS

ASTM E2300-06; Standard Specification for Highway Traffic Monitoring Devices; Current edition approved Dec. 1, 2006. Published Jan. 2007. American Society of Testing Methods International; 100 Barr Harbor, P.O. Box C700, West Conshohocken, PA 19428-2925.
ASTM E2532-06; Standard Specification for Evaluating Performance of Highway Traffic Monitoring Devices; Current edition approved Dec. 1, 2006. Published Jan. 2007. American Society of Testing Methods International.; 100 Barr Harbor, P.O. Box C700, West Conshohocken, PA 19428-2925.
Video Vehicle Detector Verification System (V2DVS) Operators Manual; California Department of Transportation, (Caltrans) Division of Research and Innovation, C(arl) Arthur MacCarley, Prof. of Electrical Engineering, Cal Poly San Luis Obispo, CA, USA; Principal Investigator. Revision 4, Jan. 28, 2007.
Project Summary: Full Deployment of the Traffic Detector and Surveillance Sub-Testbed (TDS2); C(arl) Arthur MacCarley, Prof. of Electrical Engineering, Cal Poly San Luis Obispo, CA., USA Jun. 2005.
V2SAT Video Vehicle Signature Analysis and Tracking System Deployment in California Department of Transportation District 12 Detector Testbed Operators Manual, Jun. 2005 C(arl) Arthur MacCarley, Principal EngineerV2SAT Operators Manual, Loragen Corporation, San Luis Obispo, California, USA.

(Continued)

*Primary Examiner* — Brent Swarthout
(74) *Attorney, Agent, or Firm* — SoCal IP Law Group LLP; Mark A. Goldstein

(57) ABSTRACT

A method, system and computer program product are provided for automating the task of data collection and reduction for highway vehicle detector testing. To evaluate the performance of each detector under test, a set of detection data is accumulated concurrently from each of the detectors. This data consists, at a minimum, of the time of arrival of each vehicle as reported by each detector and a digitized video image of the vehicle at the position-compensated time of detection. The data reduction process allows for applying weighting coefficients to each detection result in the formation of a consensus. These coefficients may be either fixed or adaptively adjusted based upon the learned accuracy of each detector under test. A ground truth reference data set is then generated using the weighted consensus determined from the data generated by all detectors under test. The accuracy of each detector under test is then ascertained by comparison with the ground truth data set, and these comparison results are automatically reported as indications of the accuracy of each detector under test.

25 Claims, 7 Drawing Sheets

OTHER PUBLICATIONS

A Data Fusion Approach to Automated Vehicle Detector Testing (Poster) displayed at the IEEE Digital Signal Processing Convention; Sep. 24-27, 2006, Jackson Hole, WY; by C(arl) Arthur MacCarley, Prof. of Electrical Engineering, California Polytechnic State University, San Luis Obispo, California, USA.

A Data Fusion Approach to Automated Vehicle Detector Testing; C(arl) Arthur MacCarley; Paper presented at the IEEE Digital Signal Processing Convention, Sep. 24-27, 2006, Jackson Hole, WY; by C(arl) Arthur MacCarley, Prof. of Electrical Engineering, California Polytechnic State University, San Luis Obispo, California, USA.

* cited by examiner

CONSENSUS BASED VEHICLE DETECTOR VERIFICATION SYSTEM

BACKGROUND

The detection of the presence, velocity and/or length of vehicles on roadways is increasingly recognized as critical for effective roadway congestion management and traffic safety. The use of vehicle presence detectors is common practice for traffic volume measurement, control of signalized intersections and on ramp meters. In addition, vehicle velocity and classification by length are important for automated incident detection and the characterization and prediction of traffic demand.

Real-time detection is also used for actuation of automated driver information systems, for example, the Caltrans Automated Warning System (CAWS) on I-5 in Central California. Among the commonly implemented sensing mechanisms used for vehicle detection are changes in inductance (loop detectors) or magnetic field strength (magnetometers), RADAR, optical and laser transmission or pulse time-of-flight, ultrasonic pulse return, electromagnetic signature and acoustic or signature discrimination. Detectors based on each of these methods are known to have advantages and limitations which make them appropriate for some implementations, but inappropriate for others.

Loop detectors and magnetometers must be installed in the pavement, and are therefore referred to as in-pavement detectors. Other above-mentioned detection methods require placement of the detectors above or to the side of traffic lanes, with each detector operative for one or more traffic lanes. The vehicle presence detectors associated with the various sensing methods have different detection characteristics and yield different results than inductive loop systems which may introduce uncertainties into traffic control systems if the detection characteristics are not determined.

To assess the performance of new or unproven vehicle presence detectors under varying real-world conditions, a common and objective set of standards data, generally referred to as "ground truth" data, is required. Obtaining ground truth data has traditionally been performed manually, relying on human observation, either directly at the roadway site or from the playback of videotapes.

Accordingly, manually evaluating the performance of new or unproven vehicle presence detectors is exceedingly time consuming, costly and prone to human error due to the tedium involved in comparing actual observations or video tape records to the results obtained from the detector undergoing testing. As such, a need exists in the relevant art to automate the collection of data from multiple detectors operative at the same location, the generation of the "ground truth" data set, the comparison of individual detector results with the ground truth data set, and the generation of accuracy statistics for each detector under test.

SUMMARY

In various exemplary embodiments, a method, system and computer program product are provided for automating the task of data collection and reduction for highway vehicle presence detector testing. To evaluate the performance of each detector undergoing testing, a first set of detection data is accumulated from each of the detectors. The accumulation process allows for compensation of different but proximate detection positions, so that outputs of these detectors under test can be directly compared.

In an embodiment, a digital image is acquired at the adjusted time of detection for each detector to serve as a reference of later human verification. In an embodiment, a ground truth reference data set is then generated using the outputs of all the detectors under test, optionally including a computer vision-based detection component of the system serving as a high-accuracy detector. In an embodiment, ground truth (actual vehicle detection) events, are determined by a weighted voting formula that considers the outputs of all detectors and seeking an acceptable level of agreement for each validated detection event.

The accuracy of individual detectors is determined by comparison of individual detection results with the ground truth data set. The true record of the actual time of arrival (and optionally other measurements) of every actual vehicle in each lane is referred to as the "ground truth" or reference record. The ground truth record serves as the basis for assessing the accuracy of each detector.

Ambiguous detection events are verified by a human operator using a software tool that presents the images acquired at a normalized time of detection of each detector. Once all ambiguous events have been resolved, the results for each detector are compiled and accuracy statistics generated in an automatically-generated report.

As discussed in more detail below, using the various exemplary embodiments, with little or no modification and/or user input, there is considerable flexibility, adaptability, and opportunity for customization to meet the specific needs of various users under numerous circumstances.

BRIEF DESCRIPTION OF THE DRAWINGS

The features and advantages of the various inventive embodiments will become apparent from the following detailed description when considered in conjunction with the accompanying drawings. Where possible, the same reference numerals and characters are used to denote like features, elements, components or portions of the various embodiments. It is intended that changes and modifications can be made to the various described embodiments without departing from the true scope and spirit of the various inventive embodiments as generally defined by the claims.

DETAILED DESCRIPTION

Figure 1:
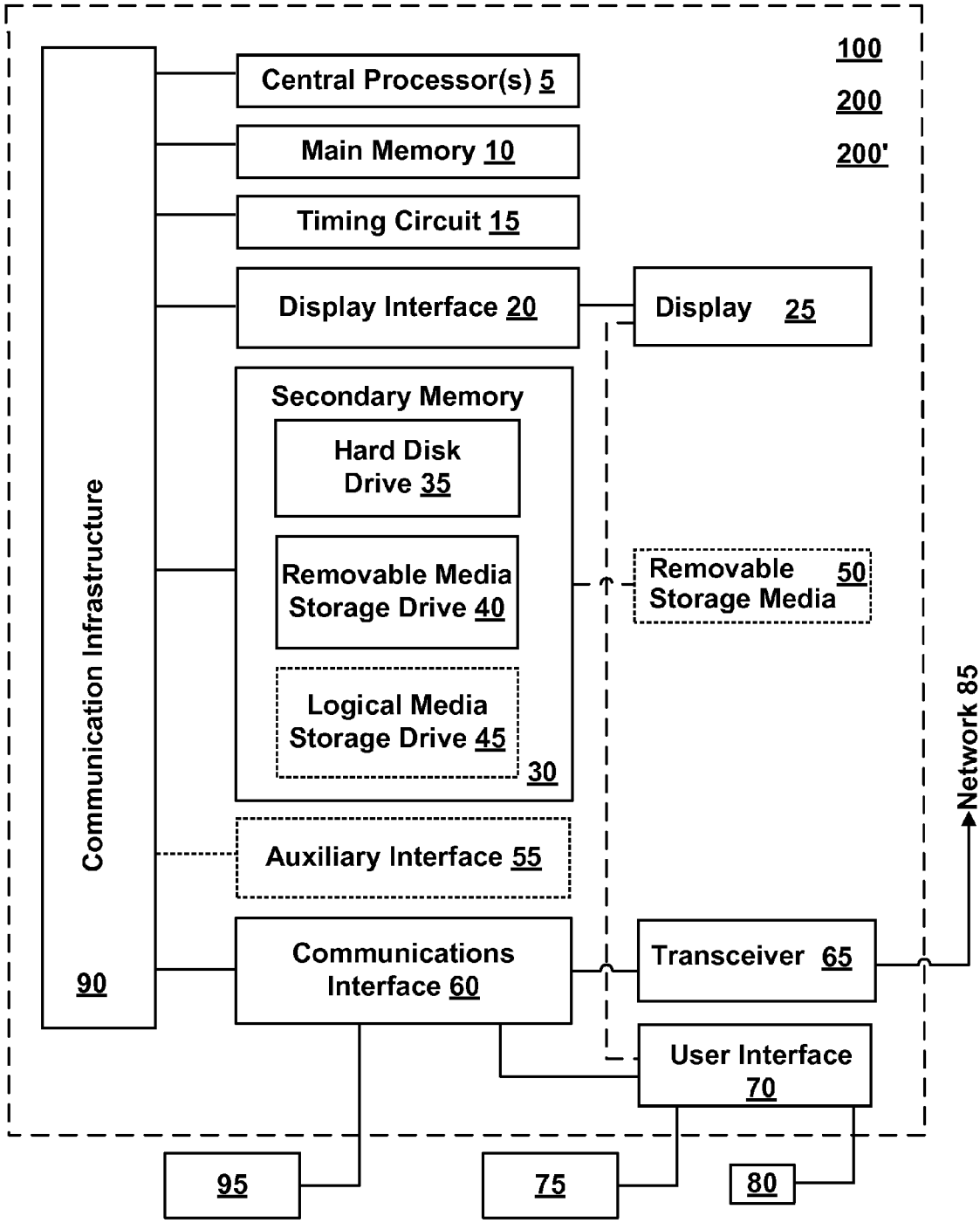
FIG. 1 is a block diagram of an exemplary computing system hardware architecture for implementing one embodiment.

Embodiments will now be discussed with reference to the accompanying figures, which depict one or more exemplary embodiments. Embodiments may be developed in many different forms and should not be construed as limited to the embodiments set forth herein, shown in the figures and/or described below. Rather, the various embodiments disclosed herein are provided to allow a complete disclosure that conveys the principles of the various embodiments, as set forth in the claims, to those of ordinary skill in the art.

In accordance with one embodiment, an apparatus and computer implemented method for fully automated data collection, reduction, verification and presentation for testing of vehicle presence detectors is presented. The apparatus records a detection event for every detector undergoing testing and for every vehicle passing through a defined field of detection. A verification digital image is also acquired for each detection event, which provides a visual record of what was detected by each detector undergoing testing.

In various exemplary embodiments, the sequence of video images may be used to both capture the presence of each vehicle traversing a predetermined area and to measure the speed of the vehicle. The computer vision detection method that is used by the system itself can serve as a high-accuracy detector of both vehicle time of arrival and speed, as well as vehicle length.

In an embodiment, evaluation of the performance of a vehicle presence detector undergoing testing is accomplished using a consensus or weighted average of the data obtained from all detectors, to be described in detail later. The consensus calculation admits various degrees of known reliability for each detector, which may be either fixed or time-adaptive based upon a recursive algorithm to be described below. In one embodiment, a particular set of detectors may be established as a trusted or reference set of detectors to which the vehicle presence detectors undergoing testing are compared with.

In an embodiment, detection data received from each different type of detectors may be weighted to adjust for biases which may occur due to varying traffic or environmental conditions.

In an embodiment, the weighting of each type of detector is applied using a time dependent function to assist in normalizing detector responses for low azimuths of the sun which generate longer shadows that are known to adversely impact video based vehicle presence detectors which lack shadow discrimination processing capability. In an embodiment, the ground truth data is automatically generated using data received from all of the detectors and filtered using user defined confidence settings.

The primary automation task is to identify records of the same vehicle reported by different detectors in a traffic lane but having different detection zones and detector response latencies. Normalized detection times are calculated from the distance (offset) of each detector's detection zone from a baseline position, using the assumption of constant vehicle velocity over the offset distance. In an embodiment, ground truth vehicle velocity may be calculated from sequential digital image frames obtained by a video camera above a traffic lane in which the camera's field of view is known (i.e., a fixed viewing geometry above the roadway.)

In an embodiment, ground truth vehicle velocity may be calculated using video processing for each vehicle by consensus of those detectors which report velocity in real time. In another embodiment, ground truth vehicle velocity may be calculated using detections obtained from duplex inductive loops spaced a known distance apart.

An analogous approach may be used to determine the length of a vehicle for classification purposes. For example, vehicle velocities are determined by processing of the acquired video images alone or in conjunction with time-of-flight measurements from duplex inductive loop detectors, if available. When both detector types are available, the determined velocities may be averaged. Normalization of detection events are thereafter based on the empirical ground truth velocities.

Raw detection times are normalized by subtraction of the pre-signal detection latency to generate the compensated time of detection. A false detection may not have a corresponding velocity measurement if no reliable velocity measurement is available from at least one of the detectors under test. In this case, the velocity of the most proximate detected vehicle in that lane is used.

A reported detection is considered valid if it occurs within a user-defined admissible time/distance aperture, centered about the normalized time of detection from all detectors, or from a designated set of reference (i.e., trusted) detectors. The failure of a detector to report a vehicle within the time/distance aperture is considered a potential failure-to-detect error, unless a proximate detection is later associated with a grouping of detections during the manual verification process. Detections occurring outside of a time/distance aperture, or multiple detections inside the same non-overlapping aperture, are considered potential false detections.

Figure 2:
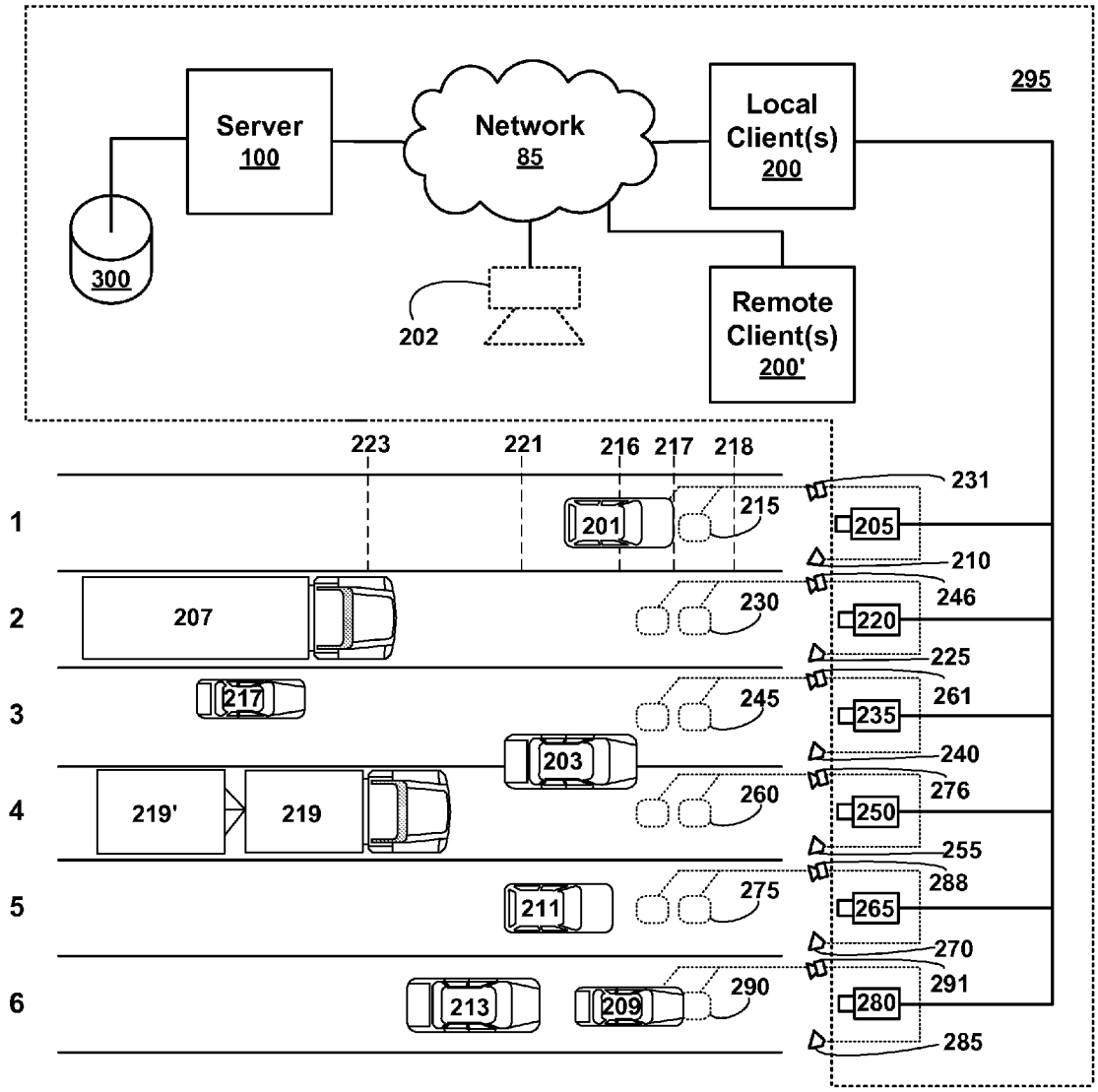
FIG. 2 is another block diagram of a multi-detector arrangement along a roadway for implementing one embodiment.

Processing, data reduction and reporting is accomplished using one or more of the exemplary computer systems having hardware architecture as is depicted in FIG. 1. The computer system 100 is configured to include a data archival server 100, a local data acquisition client 200 or a remote client 200' as is shown in FIG. 2. The computer system 100 includes a communications infrastructure 90 used to transfer data, memory addresses where data items are to be found and control signals among the various components and subsystems associated with or coupled to the computer system 100. One or more central processors 5 may be provided to interpret and execute logical instructions stored in the main memory 10. The central processor 5 may include a local cache (not shown) to improve the transfer of data between the main memory and registers of the central processor(s)

The main memory 10 is the primary general purpose storage area for instructions and data to be processed by the central processor 5. The main memory 10 is used in its broadest sense and includes RAM, EEPROM and ROM. A timing circuit 15 is provided to coordinate activities within the computer system 100 in near real time and may be used to make time-based assessments of detector data collected by one or more remote detectors and/or detectors coupled to an auxiliary interface 55. The timing circuit 15 may also be used to synchronize with one or more networked clients and/or to synchronize with an established time standard. In an embodiment, the timing circuit 15 may also be used to normalize detector signals to a common timeframe reference for comparison purposes. The central processor 5, main memory 10 and timing circuit 15 are coupled to the communications infrastructure 90.

A display interface 20 is provided to drive one or more displays 25, associated with the computer system 100. The display interface 20 is electrically coupled to the communications infrastructure 90 and provides signals to the display(s) 25 for visually outputting both graphics and alphanumeric characters. In an exemplary embodiment, a display 25 may be incorporated into the housing of the computer system 100 as for example in a laptop configuration. The display 25 may also be coupled to a user interface 70 for interacting with software being executed by the central processor 5, for example, in a touch screen embodiment.

The display interface 20 may include a dedicated graphics processor and memory to support the display of graphics or video intensive data. The display 25 may be of any type such as a cathode ray tube, gas plasma display or a solid state device such as liquid crystal display (LCD.)

A secondary memory subsystem 30 is provided which comprises non-volatile computer readable storage units such as a hard disk drive 35, a removable media storage drive 40, removable storage media 50, and/or logical media storage drive 45. One having ordinary skill in the art will appreciate that the hard drive 35 may be replaced with flash memory. The secondary memory 30 may be used to store a plurality of data including by way of example and not limitation, an operating system, device drivers, databases, user applications, application programming interfaces (API), communications applications, video capture and analyses applications, digital signal processing applications, internet browsers and plug-ins such as scripts, ActiveX controls and applets.

Where appropriate, computer programs, algorithms and routines are envisioned to be programmed in a high level language object oriented language or script, for example Java, C, C++, C#, CORBA, Visual Basic, JavaScript, and PHP. Database components may utilize any common database program, by way of example and not limitation, ORACLE, Sequel Server, Sybase, MySQL, SQL, MS ACCESS, DB2, MS FOXBASE, DBASE, PostgreSQL, and RBASE.

The removable storage drive 40 may be a replaceable hard drive, an optical media storage drive or a solid state flash RAM device. Both the removable storage drive 40 and logical media storage drive 40 may include a flash RAM device, an EEPROM encoded with programs and data, or other computer readable storage media such as an optical disk (CD or DVD), floppy disk, magnetic tape, or other media capable of being read by the central processor(s) 5.

The communications interface 60 subsystem is provided which allows for electrical connection of peripheral devices to the communications infrastructure 90 which support standard serial, parallel, USB, Firewire, PCMCIA, PS/2 connectivity and proprietary communications protocols. The communications interface 60 also facilitates the remote exchange of data and synchronizing signals between the computer system 100 and other intelligent devices in processing communications with the computer system 100 over one or more networks 85. The intelligent devices may include one or more local data acquisition clients 200 and/or remote clients 200' and detector appliances in processing communications with the computer system 100 over the network 85.

The communications interface 60 is envisioned to include a transceiver 65 normally associated with wired and wireless computer networks The transceiver 65 is envisioned to be of a type normally associated with computer networks for example, wired and wireless computer networks 85 using a network interface card (NIC) based on the various IEEE standards 802.11x, where x denotes the various present networking communications standards (e.g., 802.11a, 802.11b, 802.11g, 802.11n,) and evolving networking communications standards, example WiMax 802.16, WRANG 802.22 and BlueTooth 802.15.3a.

Alternately, digital cellular communications formats compatible with for example GSM, 3G, CDMA, TDMA and evolving cellular communications standards. Both peer-to-peer (PPP) and client-server models are envisioned for implementation. In another embodiment, the transceiver 65 may include hybrids of various computer communications standards, cellular telephone standards and evolving satellite radio standards. The user interface 70 is provided as a means for a user to control and interact with the computer system 100. The user interface 70 provides interrupt signals to the processor 5 that may be used to interpret user interactions with the computer system 100. For purposes of this specification, the term user interface 70 includes the hardware and software by which a user interacts with the computer system 100 and the means by which the computer system 100 conveys information to the user.

The user interface 70 employed on the computer system 100 may include a keyboard 75, a pointing device 80 such as a mouse, thumbwheel, track ball or touchpad. An output device, such as a printer 95 may be coupled to the communications interface 60 for outputting of hardcopy information.

An auxiliary interface 55 may be provided in client data acquisition embodiments 200 to allow connection of one or more detectors. For example, the auxiliary interface 55 may be used to connect a video frame grabber to the communications infrastructure 90. An acceptable video frame grabber is commercially available from Cyberoptics of Seattle, Wash.; located on the Internet at universal resource locator (URL) www.cyberoptics.com. The types of detectors which may be tested include but are not limited to video cameras, motions detectors, inductive detectors, capacitive detectors, binary state dependent detectors, acoustical detectors, electromagnetic detectors and optical detectors. The auxiliary interface 55 may include multiplexer (MUX), analog to digital conversion (ADC), digital signal processing (DSP) and transistor to transistor logic circuits (TTL) to convert detector signals into a format interpretable by the computer system 100, 200, 200'.

The operating system may utilize those commercially distributed by Microsoft Corporation of Redmond Wash. (e.g., Microsoft Windows); Apple Computer Inc. of Cupertino Calif. (e.g., OS X); any Unix operating system or derivatives thereof (e.g., Linux, Solaris); the Palm OS series of operating systems; or any other operating system designed to generally manage operations on a computing system 100, whether known at the time of filing or as developed later.

FIG. 2 is a block diagram of an exemplary arrangement for providing a video vehicle detector verification system 295. In an embodiment, a computer configured as a data archival server 100 is coupled to a database 300. The server 100 is in processing communications over a network 85 with one or more local data acquisition clients 200. The network 85 man be any network or network system that is of interest to a user such as a Local Area Network (LAN), a Wide Area Network (WAN), a public network, such as the Internet, a private network, a combination of different network types, or other wireless, wired, and/or a wireless and wired combination network capable of allowing communication between two or more computing systems, whether available or known at the time of filing or as later developed.

In an embodiment, the local data acquisition client(s) 200 receive detection signals from each of a plurality of vehicle presence detectors monitoring the various lanes of traffic 1-6. The detection signals are processed by the local data acquisition client(s) 200 and temporarily stored until the resulting detection data is transported to the data archival server 100 for retrievable storage in the database 300. One or more remote clients 200' may be used to remotely retrieve the data stored in the database 300 and perform detector evaluations and generate reports. Each remote client 200' includes an application which allows access to the database 300 via the data archival server 100. The remote client application may be provided as either a separate program or as browser plug-in module or applet. The remote clients 200' may also be used to control and configure the data archival server 100 and the local data acquisition clients 200.

In an embodiment, the vehicle presence detectors are provided as one or more network appliances 202 which allow direct connection of the appliances 202 to the network 85. In the network appliance embodiment, the vehicle presence detectors and data processing performed by the local client(s) 200 are combined to allow the direct connection of the detectors to the network 85 thus eliminating the need for the local data acquisition clients 200.

In an embodiment, the detector performance results are compared with detections made using traditional duplex inductive loop detectors 215, 220, 235, 245, 260, 275, 290 installed in each lane of traffic 1-6 when available. In addition, the detector performance results are automatically compared with video images captured with a plurality of video image capture cameras 205, 220, 235, 250, 265, 280 configured to record an image of the detected vehicle as it crosses a particular camera's defined field of view.

In an embodiment, the data acquisition client(s) 200 and the video image capture cameras 205, 220, 235, 250, 265, 280 comprise an image based vehicle detection system. The image based vehicle detection system 295 may be used as a separate detector in a consensus based vehicle presence detection system or as a standalone vehicle presence detection system 295. One skilled in the art will appreciate that the data acquisition client(s) 200 and data archival server 100 can be configured as a single standalone processing system. The plurality of vehicle presence detectors 210, 231, 225, 261, 240, 276, 255, 288, 270, 291, 285 undergoing testing may be compared with a reference standard, such as the duplex inductive loop detectors 215, 220, 235, 245, 260, 275, 290, a trusted detector as described below, captured video images and/or compared among the various detectors test as a group.

In an embodiment, each detector undergoing testing is positioned to detect vehicles traversing a defined section 216, 217, 281 of a lane on a highway. Likewise, a video camera 205, 220, 235, 250, 265, 280 is aligned to capture an image of each vehicle traversing each lane of the highway within the defined detection areas 216, 217, 218 for determining the performance of the detectors undergoing testing under actual conditions.

The traffic pattern of the highway depicted in FIG. 2 illustrates several common situations which cause detection difficulties depending on the type of detector employed. For example, the standard size vehicles 201, 211 in lanes 1 and 5 should be relatively easy to detect as there are no adjacent or closely following vehicles which could cause a detector to either fail to detect or miscount the number of vehicles present.

However, a different situation exists with respect to the truck 207 in lane 2. A truck presents a large detection profile, a large electromagnetic footprint, a large cross sectional area and an extended length which may cause multiple detections to occur with some types of detectors. For example, a vehicle presence detector based on RADAR will detect the truck 207 well before an automobile at the same point on the highway.

As such, an early detection may not correspond in time with the detection of the truck 207 by other detectors in the lane and thus the detectors employing RADAR technology may be penalized as a false or missed detection. Likewise, the large profile of the truck 207 may obscure a detector's view of the small automobile 217 paralleling the truck 207 in lane 3. The small vehicles 217, 209 present additional detection challenges as well due to their generally smaller electromagnetic footprint which may not always be detected by certain types of detectors.

In another example, the automobile 203 spanning lanes 3 and 4 presents a situation where the vehicle 203 may be detected by one or more of the detectors in both lanes 3 and 4, only the detectors in lane 3, only the detectors in lane 4 or not detected at all. This situation is particularly problematic for the duplex inductive loop detectors 245, 260 in adjacent lanes 3 and 4 since a vehicle may have a sufficiently large electromagnetic footprint to trigger detections within both lanes 3 and 4, thus receiving 2 false detections for a single vehicle.

In another example, a dual trailer truck 219 (or an automobile towing a trailer) as is found in lane 4 provides another detection challenge. The gap between the first and second trailer sections 219, 219' may be interpreted by one or more of the detectors as two closely following vehicles rather than as a single extended length vehicle. This again could result in a false detection of the second trailer section 219'. Likewise, the duplex inductive loop detector 260 may sense the change in inductive field strength as a gap between the trailer sections rather than as one extended length multi-segmented vehicle.

Conversely, the two closely spaced vehicles 209, 213 in lane 6 may be interpreted by the detectors as a single larger vehicle rather than two separate vehicles by the duplex inductive loop detector 290. For example, if the lead vehicle 209 triggers a detection in the second inductive loop at about the same time the following vehicle 213 triggers a detection in the first inductive loop 290, only a single detection may result. In this situation, the proximity of the vehicle to a median detection time is used to discriminate cases of nearly equal detection probability when detection zones for closely following vehicles overlap.

For explanatory purposes, the operation of the detectors 205, 210, 231 monitoring lane 1 is described detail below. However, the same general concepts apply for the detectors associated with the remaining lanes 2-6. As the vehicle 201 in lane 1 approaches the duplex inductive loops 215 embedded in the highway, the metal in the vehicle 201 changes the inductance in the first inductive loop. The duplex loops 215 are spaced at a fixed longitudinal distance apart (usually 20 feet) which allows determination of the velocity of the vehicle 201 as it traverses the first and second loops 215.

Since the metal mass of the vehicle 201 and the resting inductances of the two loops are constant, a reasonably accurate determination of the vehicle's velocity can be determined. For detection verification, a video camera 205 having a defined field of view sequentially records video images (i.e., frames) of the position of the vehicle 201 as it traverses the camera's field of view 216, 217, 218. Since the field of view of the video camera is fixed and known, the velocity of the vehicle 201 can then be determined using either the velocity of the vehicle provided by the duplex inductive loops 205 or by the exemplary image processing techniques described below to identify the leading edge of the vehicle as it traverses the camera's field of view which includes the fixed reference points 216, 217, 218.

The elapsed time required for the vehicle to travel between the reference points 216, 217, 218 is determined from the rate of frame extraction, which is typically set at 60 frames per second when analog video cameras are employed. The velocity of the vehicle is then calculated using the elapsed time between the fixed reference points 216, 217, 218. If the detector 210 undergoing testing within lane 1 detects the vehicle 201 traversing lane 1, the detection signal is processed and where appropriate, normalized to coincide with a detection event obtained independently using the video camera imaging 205 and/or the duplex inductive loops 215. When both the inductive loops and a video camera are present, the two separately derived velocities may be averaged.

In an embodiment, discrete video images of the vehicle 201 are obtained by a video frame grabber to extract sequential video frames from a National Television System Committee (NTSC) compliant video camera. The video frames are converted into jpeg formatted files for transport to the data archival server 100. The video grabber is typically disposed internally in a peripheral device slot associated with the local data acquisition client 200. The video grabber is only needed in situations where an analog video camera is used. Digital video cameras may be used which eliminates the need for the video frame grabber. The video images obtained are temporarily stored in a buffer or queue associated with the local data acquisition client 200 and is time-stamped by the receiving local client 200 to allow for normalization of detection thresholds. Additional normalization may be provided for detector latency. Time-stamping of the digital images allows the local data acquisition client 200 to associate a digital image with a particular detection event.

In an embodiment, the digital images are automatically examined by the video vehicle verification system 295 using the image processing techniques described below to determine the leading edge of the vehicle as it passes by the fixed reference points 216, 217, 218. The elapsed time between reference points within the camera's field of view is determined from the rate of frame extraction, which is typically set at 60 frames per second. The velocity of the vehicle is then calculated using the elapsed time between the start 216 and endpoints 218 within the field of view of the video camera 205.

In circumstances where a false detection may not have a corresponding velocity measurement, the velocity of the nearest proximate vehicle in the same lane is used. A reported detection is considered valid if it occurs within a user-defined admissible time/distance window, centered about the average normalized detection time from all detectors. In an embodiment, a reference detector may be used as a trusted detector.

The failure of a detector to report a vehicle within the normalized time/distance window is considered a potential failure-to-detect error, unless a proximate detection is later associated with that detection during manual verification. Detections occurring outside of the normalized window, or multiple detections inside the same non-overlapping window, are considered potential false detections. Proximity to the normalized detection time is used to discriminate cases of nearly equal admissibility when detection windows for closely following vehicles overlap.

Programmatic Normalization of Time of Detection

Figure 2A:
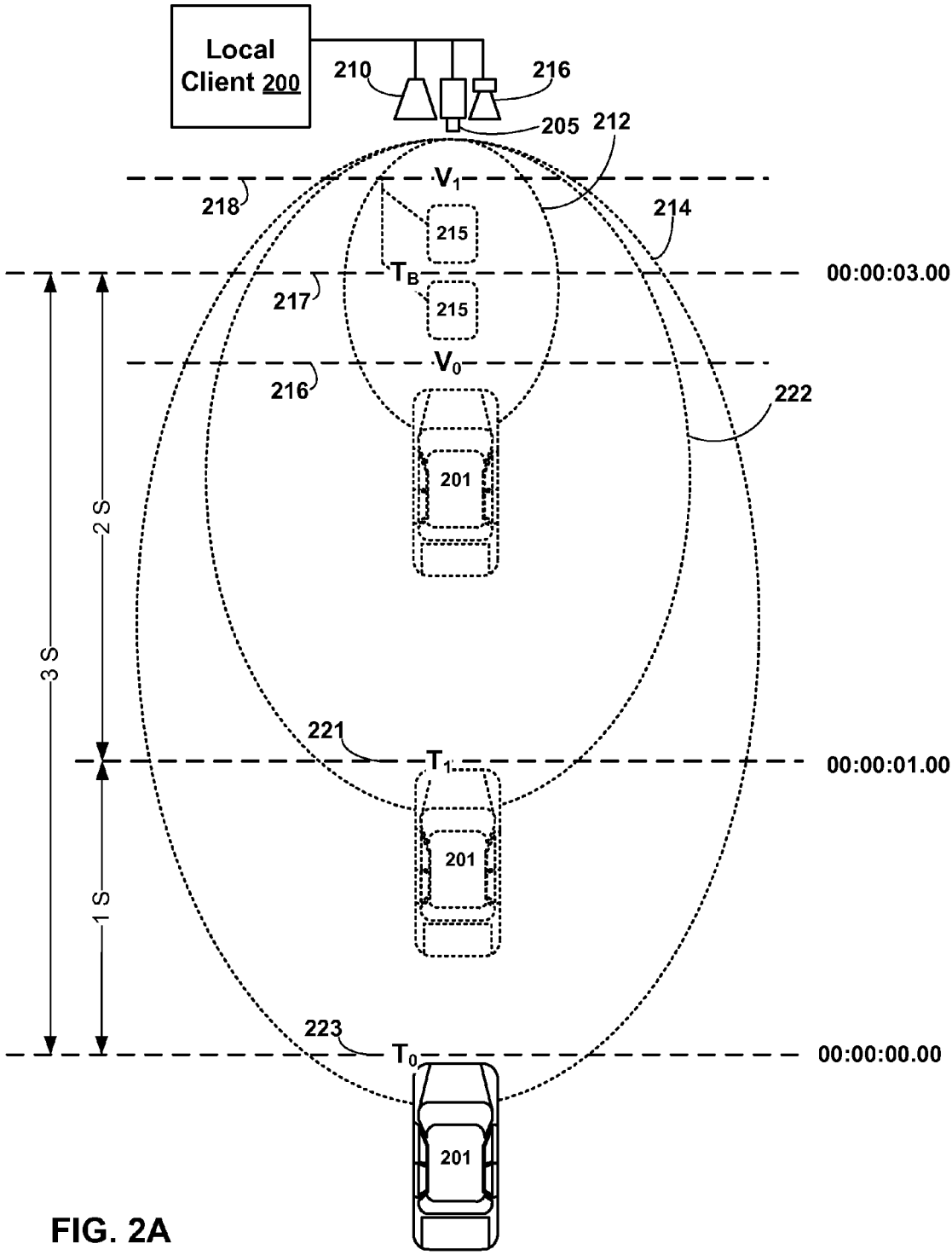
FIG. 2A is another block diagram of variations in detection times and/or detection threshold distances.

Referring to FIG. 2A, an example is provided which illustrates how detectors having differing detection distance thresholds are spatially and/or temporally normalized to allow capture of a digital image which can later be used to determine if the triggering detector actually detected a vehicle or if a false detection occurred. Missed detections are determined by other detectors monitoring the same lane of traffic.

It has been empirically determined that certain types of vehicle detectors have threshold detection distances up to several hundred feet from the duplex inductive loop detectors 215 and/or by capture using the video camera 205 as a separate detector system 295. Continuing with the example of the vehicle 201 travelling in lane 1, a detector 210 first detects the vehicle 201 as it approaches a first position T0 223. Assuming for example, that this detector 210 provides a first detection signal to a local data acquisition client 210.

If a single digital image were taken at about this first time 00:00:00.00, the digital image would not match the vehicle within the field of view 212 of the camera 205. Likewise, when the vehicle reaches a second position T1 221 another detector 216 detects the vehicle 201 approaching and sends another detection signal to the local data acquisition client 200 a second later at time 00:00:01.00. As before, the second detection signal arrives at the local data acquisition client 200 well before the vehicle is within the field of view 212 of the video camera 205.

It is not until the vehicle arrives at a third position TB 217 at time 00:00:03.00 that this vehicle appears in the field of view 212 of the video camera 205 and is detected by either or both the duplex inductive loop detector 215 and/or the digital image capture 205. The duplex inductive loop detector 215 and/or the digital image capture detect the presence of the vehicle 201 which triggers a reference image capture.

As discussed above, determining the velocity of each detected vehicle is necessary to normalize detection times (and/or offset detection distances) for various detector types having different detection latencies, detection thresholds and detection distances. The normalization of detection times allows for the generation of an unbiased comparison between different detector types. In an embodiment, the normalization is also used to identify the closest image to a normalized detection event for comparison, manual correction or acquiring ground truth data.

In an embodiment, the normalization allows for data reduction purposes to facilitate the fair comparison of detections of the same vehicle reported by different detectors under test. Also, in embodiments employing video imaging, normalization allows the correct image of the vehicle 201 to be acquired by the video capture system 295 while the vehicle 201 is in the field of view 212 of the video camera 205, even if the position of detection is beyond the field of view.

Detection times are compensated or normalized to a common reference position, despite different actual positions of detections. This compensation for different detection positions requires two additional pieces of information: the position of detection for a given detector, and an estimate of the vehicle speed. The known detection position offset from the reference or baseline position TB 217 for a give detector is divided by the estimated vehicle speed to calculate a pre-trigger time prior to the actual time of detection.

In an embodiment, a sequence of digitized video images is accumulated in a continuous circular buffer or queue of the receiving local client 200. The pre-trigger delay time is then used to select the previously recorded image in the buffer or queue, which will show the vehicle 201 when it was at the baseline position TB 217 in the field of view 212 of the video camera 205, even for detection positions that are well past the camera field of view.

The velocity of the vehicle can be determined by the local client's video image processing algorithm based on optical flow time-of-flight, or it can be a speed value reported by one or more the detectors under test, or an average of all of these.

Not all detectors are capable of reporting speed, so the speed is usually calculated as the weighted average of the available detectors that are capable of reporting vehicle speed. In an embodiment, weighting coefficients may be used in the calculation of this weighted average can be fixed values or adaptively-determined values, using the same adaptive update approach used for determining the weighted consensus of the detector outputs for generation of ground truth as is described below.

The speed calculation determined by the image processing capability of the local client 200 is performed by a real-time computer implemented process that analyzes the sequence of video frames or fields, measuring the linear progression of the vehicle 201 through the progression of images and approach at defined locations 216,217, 218 within the field of view 212 of the video camera 205. Several computer implemented processes can be used to determine vehicle speed from this progression of vehicle positions.

In one embodiment, the elapsed time or frame count between fixed positions 216, 217, 218 in the field of view 212 can be used to perform a simple time-of-flight calculation of speed, by dividing the separation distance by the elapsed time. In one embodiment, the positions of the vehicle 201 measured from the video image sequence are fitted to a polynomial equation using a least-squares curve fitting calculation. The least squares curve fit yields the coefficients of a polynomial that predicts the position of the vehicle as a function of time.

The polynomial is then differentiated with respect to time to calculate the vehicle speed. The simplest polynomial in this case is a linear equation relationship (equation of a line) which would subtend the actual progression of positions if the vehicle speed remains constant during the period of observation and no optical distortion was introduced by the camera lens system or field of view 212 as defined in one embodiment by the equation $x=a\mathbf{1}*vt+a\mathbf{0}$, where x is the vehicle position and t is time and a0 is the initial position of the vehicle at the start of the measurement sequence when t=0. Differentiating this linear equation with respect to time reveals that the coefficient a1 is the estimated vehicle speed over the entire progression of vehicle position measurements.

Data Handling

With reference to FIGS. 2 and 2A, a detection event from the detector 205, 210 216 undergoing testing is processed by the local data acquisition client 200 proximate to a detector 205, 210 216. The local client 200 generates a time dependent log file for each detection event which is temporarily stored locally on the local data acquisition client 200. Separate time dependent digital images are accumulated before and after the normalized detection time are likewise temporarily stored in a rolling file for video processing. In an embodiment, the detection log file has a format of;

A 1 0710310116301550 65.0 150.0 S

Where:

A=Detector Code (A single letter is assigned to each detector)
1=Lane number
07=Year 2007
10=Month (October)
31=Day of the month
1630=24-hour time in hours and minutes (4:30 PM)
1550=15.50 seconds
65.0=Calculated velocity (Miles per hour)
150.0=normalized detection offset in distance (Feet)
S=Site identifier The video images coincident with a normalized detection event are saved in a time stamped jpeg format. The digital image file maintains a resolution of 640×320 pixels as a balance between image resolution, data processing and data archival requirements. The most relevant digital image (i.e., image closest in time to the normalized detection event) is retained for visual comparison and performance evaluation purposes. The bulk of the processing performed by the local data acquisition client 200 involves the capturing and processing of the video frames generated from the video camera.

The detection log files and the most time relevant digital image are either "pushed" to the server 100 by the client 200 or if there is a temporary connectivity problem between the server 100 and client 200, "pulled" by the server upon reestablishment of the connectivity over the network 85. The server 100 includes programmatic instructions to prevent pulling of a log file when the client 200 is attempting to "push" the same file to the server 100. Additional programmatic instructions are provided for the server 100 to ensure that a complete log file and image is being "pulled" rather than one in the process of being written to a hard drive 35 associated with the local client 200.

In an embodiment, each lane of traffic has a dedicated local client 200 assigned thereto. This arrangement minimizes the data processing load on any single local client 200. In another embodiment, a single multi-core processor employed in a local client 200 may be used to perform both the data acquisition and data archival functions of the server 100. One skilled in the art will appreciate that various combinations of computer systems may be used to accomplish the data acquisition, digital image reduction and archival functions described herein.

The data archival server 100 includes a database 300 for storing of accumulated detector data and associated video image files. In an embodiment, the incoming log file is parsed by programmatic instructions executing on the server 100 to populate a new database record for future review and performance evaluations of the various detectors 210, 225, 231, 240, 246, 255, 261, 270, 276, 285, 288 undergoing testing. The incoming image file is logically associated with the new database record based on the normalized detection time and/or by using a unique identifier assigned with the newly created detection record. In an embodiment, the image file is stored in a separate directory which is referentially linked to the new database record containing the detection event.

Once a statistically significant sample size has been accumulated in the database 300 for evaluating the detector undergoing testing, a number of user selectable queries and editing tools may be executed from a remote client 200'. The remote client 200' allows a user to assign ambiguous detections of one detector to a group of detections made proximately with other detectors and visa versa. The database 300 may be established with user access privileges which control what actions a user is permitted to perform on the database 300. A number of different reports may be generated and output from the remote client 200'. For example, detector performance results may be output as is provided in Table 1 below.

TABLE 1

| Detection Results | | | | | | |
|---|---|---|---|---|---|---|
| | Lane 1 | Lane 2 | Lane 3 | Lane 4 | Lane 5 | Lane 6 |
| Detector R | | | | | | |
| | 165 | 222 | 274 | 188 | 294 | 308 |
| Detector A | | | | | | |
| Verified | 164 | 222 | 273 | 187 | 293 | 306 |
| Fail | 1 | 0 | 1 | 1 | 1 | 1 |
| False | 0 | 0 | 0 | 0 | 0 | 1 |
| Indeterminate | 0 | 0 | 0 | 0 | 0 | 0 |
| Detector B | | | | | | |
| Verified | 156 | 213 | 266 | 180 | 274 | 291 |
| Fail | 9 | 9 | 6 | 6 | 20 | 17 |
| False | 0 | 0 | 1 | 0 | 0 | 0 |
| Indeterminate | 0 | 0 | 0 | 1 | 0 | 0 |
| Detector C | | | | | | |
| Verified | 159 | 216 | 270 | 181 | 290 | 304 |
| Fail | 6 | 5 | 3 | 5 | 3 | 4 |

TABLE 1-continued

| Detection Results | | | | | | |
|---|---|---|---|---|---|---|
| | Lane 1 | Lane 2 | Lane 3 | Lane 4 | Lane 5 | Lane 6 |
| False | 0 | 0 | 0 | 1 | 1 | 0 |
| Indeterminate | 0 | 1 | 0 | 0 | 0 | 0 |
| Detector D | | | | | | |
| Verified | 163 | 221 | 271 | 185 | 293 | 305 |
| Fail | 1 | 1 | 1 | 1 | 1 | 1 |
| False | 0 | 0 | 1 | 1 | 0 | 1 |
| Indeterminate | 0 | 0 | 1 | 1 | 0 | 1 |

The data included in Table 1 is intended as exemplary only. However, assuming that the data was obtained from six different detector types all simultaneously viewing the same traffic within each lane 1-6, the report would indicate that Detector R performed about the same as Detector A and that results of varying accuracy were obtained from Detectors B-D, with Detector B providing the least accuracy under the same testing conditions encountered by the remaining detectors. In order to ensure that fair comparisons are being made between each detector and the reference detector R, the detection events are normalized as is described above.

In one embodiment, a trusted detector R is used for comparison with the detectors undergoing testing. In this embodiment, a simple acceptable detection percentage relative to the trusted detector R is used to determine whether to include or exclude detectors for at least obtaining ground truth data. In this embodiment, the local clients 200 are programmed to accumulate detections from the vehicle presence detectors 210, 231, 225, 246, 240, 261, 255, 276, 270, 288, 285, 291 and normalize the detection events as described above. Optionally, digital images may be obtained as described above using the video cameras 205, 220, 235, 250, 265, 280. The remote client(s) 200 are then used to evaluate the performance of each detector with respect to the trusted detector R to determine which detection results to include in ground truth data. For example, simple detection percentages as compared to the reference detector R based on a desired confidence level (95%) as is provided in Table 2 below.

TABLE 2

| Detector Performance (95% Detection w/Ref) | | |
|---|---|---|
| Detector | Results % | Use? |
| Detector R | 100 | 1 |
| Detector A | 98 | 1 |
| Detector B | 98 | 1 |
| Detector C | 70 | 0 |
| Detector D | 88 | 0 |
| Detector E | 95 | 1 |

Based on the results, Detectors C and D should not be used in determining the ground truth as these detectors did not provide at least 95% of the detections determined by the trusted detector R. During actual performance evaluation of all the detectors, the remote clients 200' are programmed to treat normalized detection events obtained from detectors A, B and E as the ground truth for comparison with the other detectors. In another embodiment, a consensus of all detectors may be programmatically be employed by the remote clients 200' as is described below.

Programmatic Ground Truth Generation by Consensus

In an embodiment, the ground truth data is programmatically determined by a weighted consensus of the detection decisions made by each detector under test. In addition, the processing capabilities of the optional video vehicle verification system 295 may be used as well.

In an embodiment, each detector is assigned an index number where i is the detector index (an integer value, i=1,2 . . . n). A typical value for n is 8 detectors under test.

Each potential vehicle detection event is assigned an index number k index (an integer value) where k=1, 2 . . . m. A detection by any one or more of the individual i detectors can cause a detection event. Typically, a dataset obtained for an hour would yield about m=2,000 detection events for a centrally located traffic lane on a high-usage highway.

The detection outcome for each detector i with respect to any detection event k is either 0 for no vehicle detected or 1 vehicle detected, i.e., $d_i(k)=\{0,1\}$, where $d_i(k)=1$ for a detection and $d_i(k)=0$ for no detection during that event.

The actual ground truth presence or non-presence of a vehicle during event k is determined by a weighted consensus (voting) process in which the results $d_i(k)$ for each detector i are programmatically combined as follows:

A function g(k) is used to represent the ground truth analog conclusion (a real number between 0 and 1) for $i^{th}$ detection event (possible vehicle). In this embodiment, $G(k)=\{0,1\}$ represents the binary conclusion for the $k^{th}$ ground truth detection event (possible vehicle detected within the admissible time and/or distance window for the $i^{th}$ event.) The consensus conclusion G(k) for event k is programmatically determined by thresholding a weighted average according to the function;

$$g(k) = \left( \frac{\sum_{i}^{n} a_i d_i(k)}{\sum_{i}^{n} a_i} \right),$$

where $a_i$=weighting coefficient for detector i, and $$G(k) = \begin{cases} 0 & g(k) < \gamma_{lower} \\ \lambda & \gamma_{lower} \leq g(k) < \gamma_{upper} \\ 1 & g(k) \geq \gamma_{upper} \end{cases}$$

where typical values of the threshold γ constants are $\gamma_{lower}=0.4$, $\gamma_{upper}=0.6$. This range defines ambiguous detection results which are user provided parameter entries.

G(k)=0 implies that the consensus for that event was that no vehicle was actually present.

G(k)=1 implies that the consensus for that event was that a vehicle was actually present.

G(k)=λ implies that their was no consensus (i.e., ambiguous results) for that event, in other words, the ground truth determination was inconclusive. λ is a variable that remains undetermined until a human user of the system software makes the final decision as to the presence or non-presence of a vehicle during that event, based upon observation of the images acquired by the system during that event. If the detection is manually verified to be false, λ=0 and therefore G(k)=0. Conversely, if the detection is manually verified to be true, λ=1 and therefore G(k)=1.

Programmatic Determination of the Accuracy of Each Detector Under Test

In an embodiment, once a ground truth record has been established for a particular data set consisting of a sufficient number of events k, the "correctness" of each detector i under test is found by comparison of its reported detection value for each event with that of the ground truth record. In an embodiment, $c_i(k)=\{0,1\}$ represents the programmatic result of the comparison of the response of detector i with the consensus response G(k) during event k according to the function $c_i(k)=d_i(k)\otimes G(k)$, where ⊗is the logical exclusive NOR (XNOR).

Therefore $c_i(k)$ is equal to logical 1 only when both $d_i(k)$ and G(k) have the same logical values, and $c_i(k)$ is equal to logical zero when then they differ. In other words, $c_i(k)=1$ if an individual detector i agrees with the consensus conclusion for event k, and $c_i(k)=0$ if the detector i disagrees. As with the simple percentage test discussed above, results for each detector are compared with the resultant ground truth data set, and statistics of the type shown above in Table 1 are automatically generated by the remote client(s) 200'.

Programmatic Adaptive Generation of Weighting Coefficients

In an embodiment, weighting coefficients $a_i$ are programmatically applied to the voting process described above. The weighting coefficients $a_i$ can either be fixed, based upon human operator assumptions about the relative reliability of each detector, or can be "learned" or "adapted" during the course of a data reduction run, based upon the consistency of the agreement between $d_i(k)$ and G(k).

The weighting of each $a_i$ value corresponding to each detector under test allows the discrimination of consistently reliable from consistently unreliable detectors. For video-based detectors, it also allows for time compensation of the reliability of detector responses with changes in the illumination conditions, which tend to cause video based detectors to become error-prone under conditions of low azimuths of the sun which generate long shadows that are known to adversely impact video based vehicle presence detectors.

In an embodiment, all detectors start with weighting coefficients $a_i$ equal to 0.5. If adaptation is elected, an initialization period of a few hundred detection events (actual vehicles and/or false detections) is typically allowed to elapse to allow the weighting coefficient values to stabilize before conducting a final detector accuracy data reduction run (i.e., actual performance evaluation.)

In one embodiment, a simple recursive filter is used to gradually adapt the weighting coefficient for the $i^{th}$ a detector based upon its agreement or disagreement with the consensus for each event k. The weighting coefficient $a_i(k)$ is slightly modified with each sequential detection event according to the function $a_i(k+1)=a_i(k)(1-\alpha)+(\alpha)c_i(k)$ where α is a small factional constant, typically set to 0.05 if a 95% confidence level is desired by the user.

With each successive event k, $a_i(k)$ increases if detector i agrees with the consensus and decreases if detector i disagrees with the consensus. The ultimate limits of $a_i(k)$ are between 0 and 1. If every detection is correct (i.e., agrees with the consensus), $a_i(k)$ asymptotically approaches 1, while if a detector consistently fails to detect or falsely detects $a_i(k)$ asymptotically approaches 0. Optionally, upper and lower limits can be set for $a_i(k)$. Accordingly, detectors that are consistently incorrect are devalued in the consensus voting conclusion, while consistently accurate detectors are more strongly weighted in the consensus voting conclusion.

Figure 3:
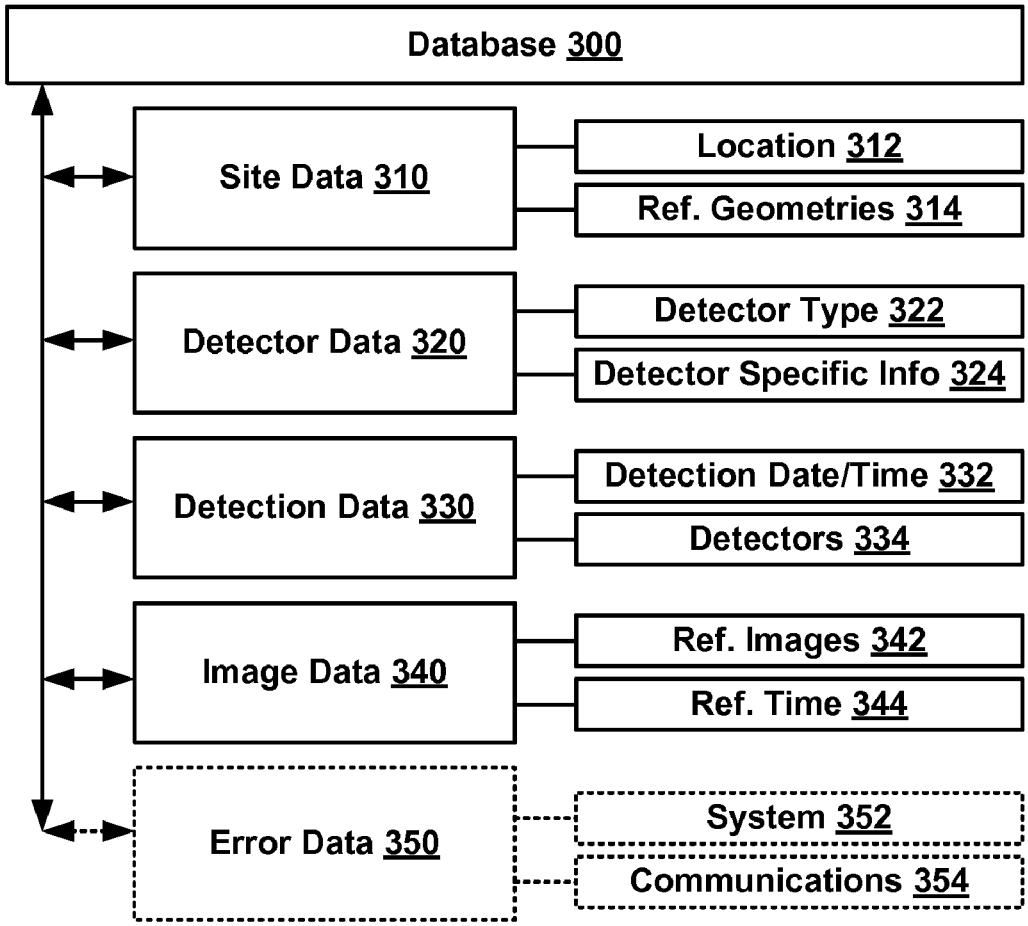
FIG. 3 is an exemplary data structure for accumulating detector data in a database in accordance with one embodiment.

Referring to FIG. 3, an exemplary database arrangement 300 is depicted for archiving detection and other data in records received from a local client 200. The database 300 includes a first data structure which represents site data 310. The site data provides a location description 312 field and a reference geometry field 314 for setting up the video cameras overlooking a roadway.

The location description may include geo positional coordinates (e.g., latitude and longitude) to allow selected implementation of shadow rejection processing. A second data structure is provided which represents detector data 320. The detector data provides a detector type field 322 and a detector specific field 324. The detector specific field(s) 324 may include detector latency and distance correction factors. A third data structure 330 which represents detection data received from the local client 200. The detection data provides a detection chronological field 332 (date, time) and a detector cross reference to the detector data structure 320. A fourth data structure is provided which represents image data 340.

The image data structure 340 includes a reference image field 342 and reference time field 344 which is cross referenced to the detection data structure 330. The actual image files may be stored externally to the database 300 by providing a directory and file name in the reference image field 342. An optional fifth data structure is provided which represents error data 350. The error data structure includes a system error field 352 and a communications error field 354.

Data Acquisition and Pre-Processing

Figure 4:
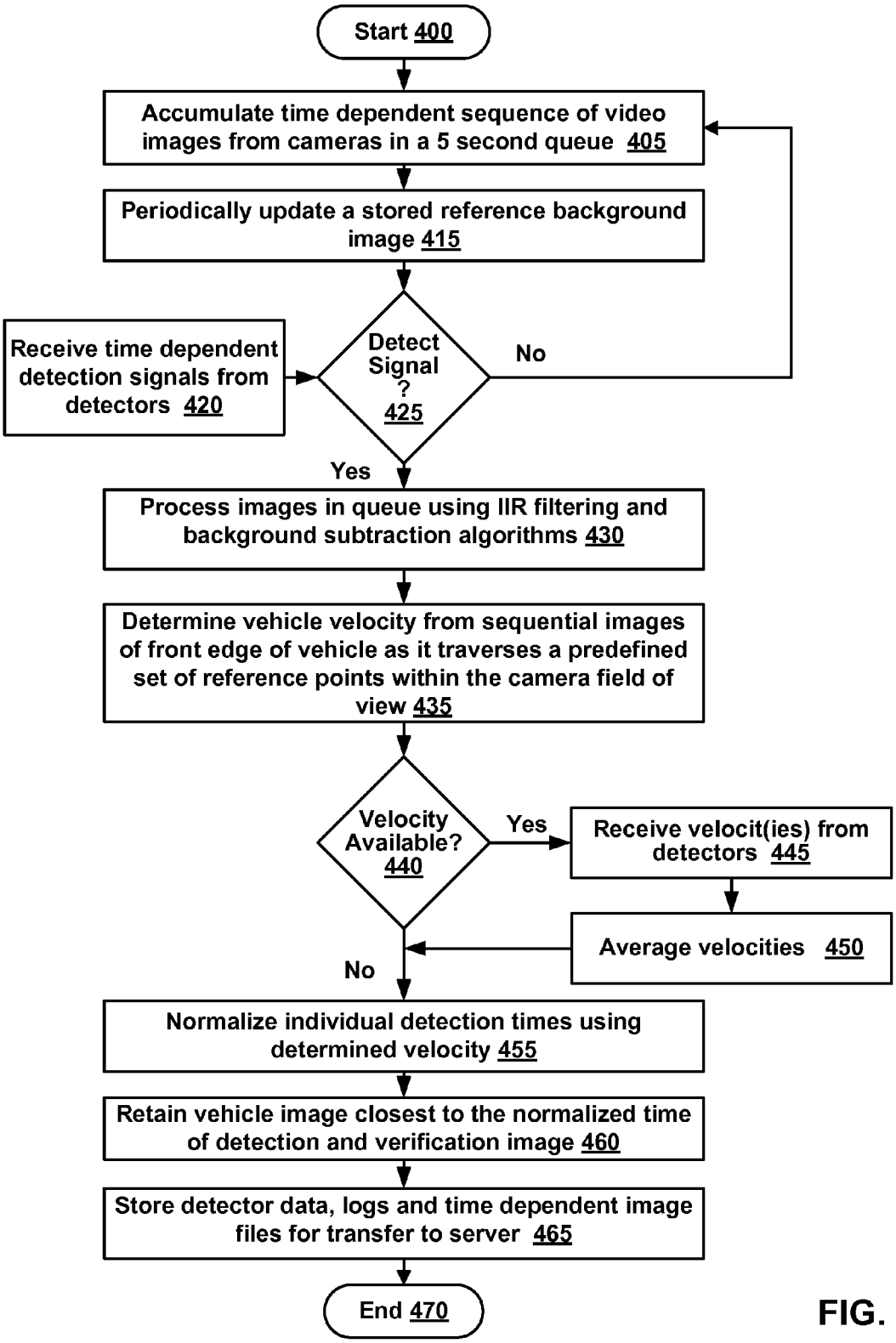
FIG. 4 is a flow chart depicting a data acquisition process for vehicle detector data received by a local client in accordance with one embodiment.

Referring to FIG. 4, a computer implemented process is illustrated in which data acquisition is performed by a local client 200. The process is initiated 400 by accumulating time-dependent video images in a rolling memory buffer or queue. In an embodiment, the buffer or queue maintains approximately 300 separate images obtained at a rate of about 60 frames per second or approximately 5 seconds of video images. The background view of the highway as seen by the video cameras is periodically updated 415 to account for changes in ambient lighting conditions. In an embodiment, the background images are used in the processing of digital images representing vehicle detections.

The accumulation of video images continues in a first-in first-out (FIFO) progression 425 until one or more time dependent detection signals 420 are received by the local client 200. At this point, the current video images identified with a latency corrected detection event by time are processed using infinite impulse-response filtering (IIR) 430.

IIR filtering is a digital signal processing technique which subtracts the periodically updated background image from each of the video images 430. A portion of the resulting processed video images provides a time sequence of the detected vehicle isolated from the background as it traverses the video cameras' field of view. The background subtraction performed by the image processing applications simplifies the task of identifying the leading edge of the vehicle at various points within the camera's field of view until the leading edge of the vehicle has spanned a known reference distance; from which, the velocity of the vehicle is determined 435. In an embodiment, the background subtraction processing provides a uniform background color surrounding the vehicle which simplifies differentiation of the pixels associated with the vehicle itself by differences in colors.

In an embodiment, if the velocity of the detected vehicle is available from one or more of the detectors 440, the velocity (ies) are received from the detectors 445 and may be averaged 450 with the velocity determined above 435.

The velocity determined by the video capture system or averaged as above 450 may be used as a reference standard for normalizing all detections to a common detection time and/or spatial distance. In another embodiment, the average of all detection times 455, corrected for detector response latency is used to normalize the detections to an average detection time. In an embodiment, a weighted consensus detection mechanism as previously described is used as a reference to determine verified, failed, false or indeterminate detections by any single detector in an entire detection array of detectors for a traffic lane.

As may be apparent, all of the local clients and detectors need to be periodically synchronized with a standard network timekeeping source, such as the National Institute of Standards and Technology, found at URL www.nist.gov. Time drift could cause improper image selection and thus incorrectly record an image unrelated to a detection event.

The image file which is closest in time to the average detection time is retained 460 along with the detection log file(s) 465 for transport to the data archival server 200. For exemplary purposes only, processing ends 470 in FIG. 4. However, in reality, the mechanism described above operates as ongoing process.

Data Archival

Figure 5:
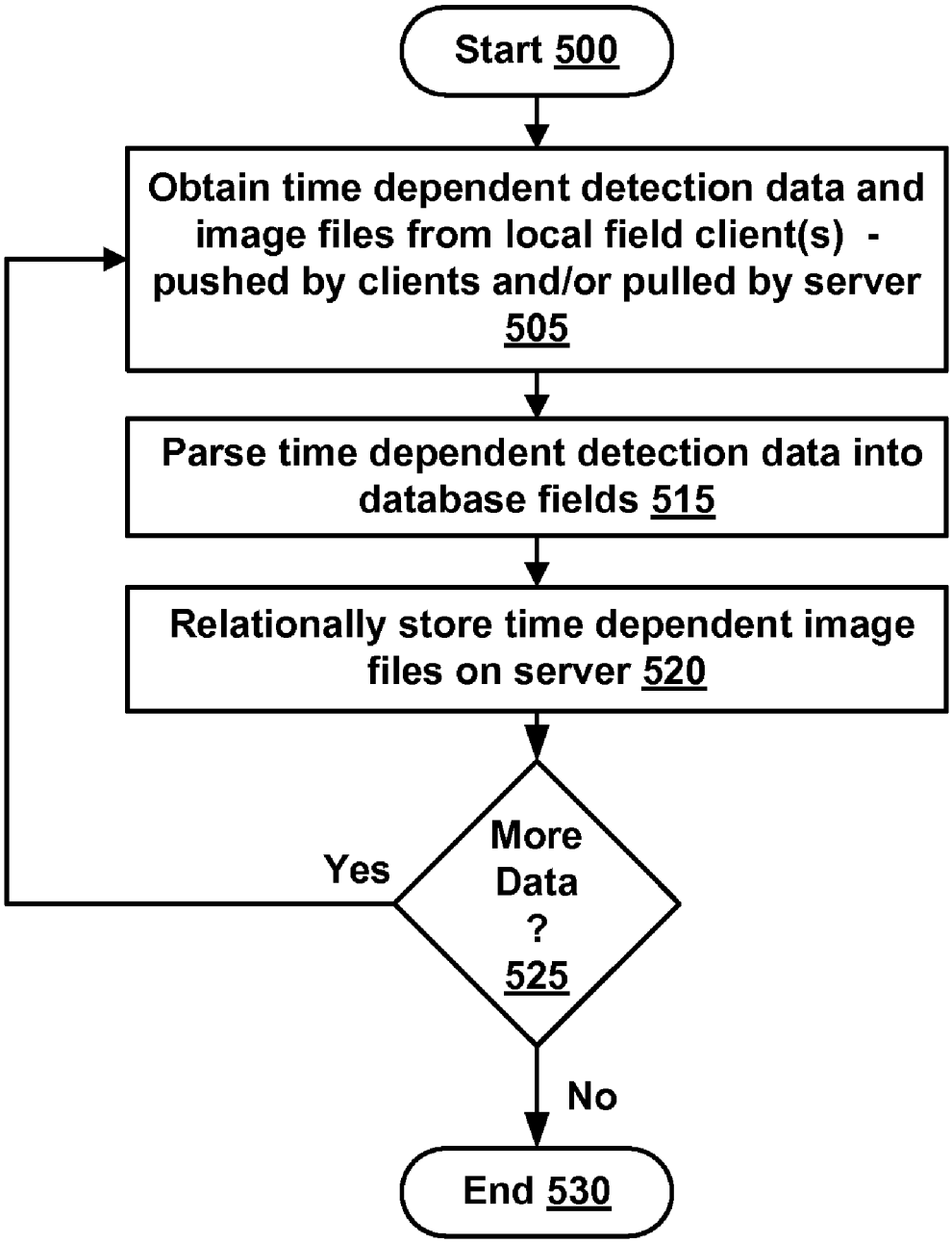
FIG. 5 is a flow chart depicting a data archival process for vehicle detector data received by a server in accordance with one embodiment.

Referring to FIG. 5, a computer implemented process which illustrates data archival performed by the data archival server 100 is provided. The process is initiated 500 by the server 100 obtaining time dependent detection data and corresponding image files from the client 200 located in the field 505. The detection and image data may be retrieved by the server 200 in a "pull" operation using a PHP script following a communications outage or other communications interruption. Alternately, in one embodiment, the local client 200 may perform a "push" operation using a JavaScript when a communications connection between the local client 200 and the server 100 is reliably available.

The obtained time dependent detection data is parsed by the server 515 and stored in records of the database 300. The time dependent image files may likewise be stored in the database 300, or alternately stored separately, while retaining a retrievable relationship with associated time dependent detection records 520. If more detector data and/or images are available 525, the process repeats until all the time dependent detector and image data 525 is recorded in the database, thus ending this process 530.

Programmatic Detector Performance Evaluation

Figure 6:
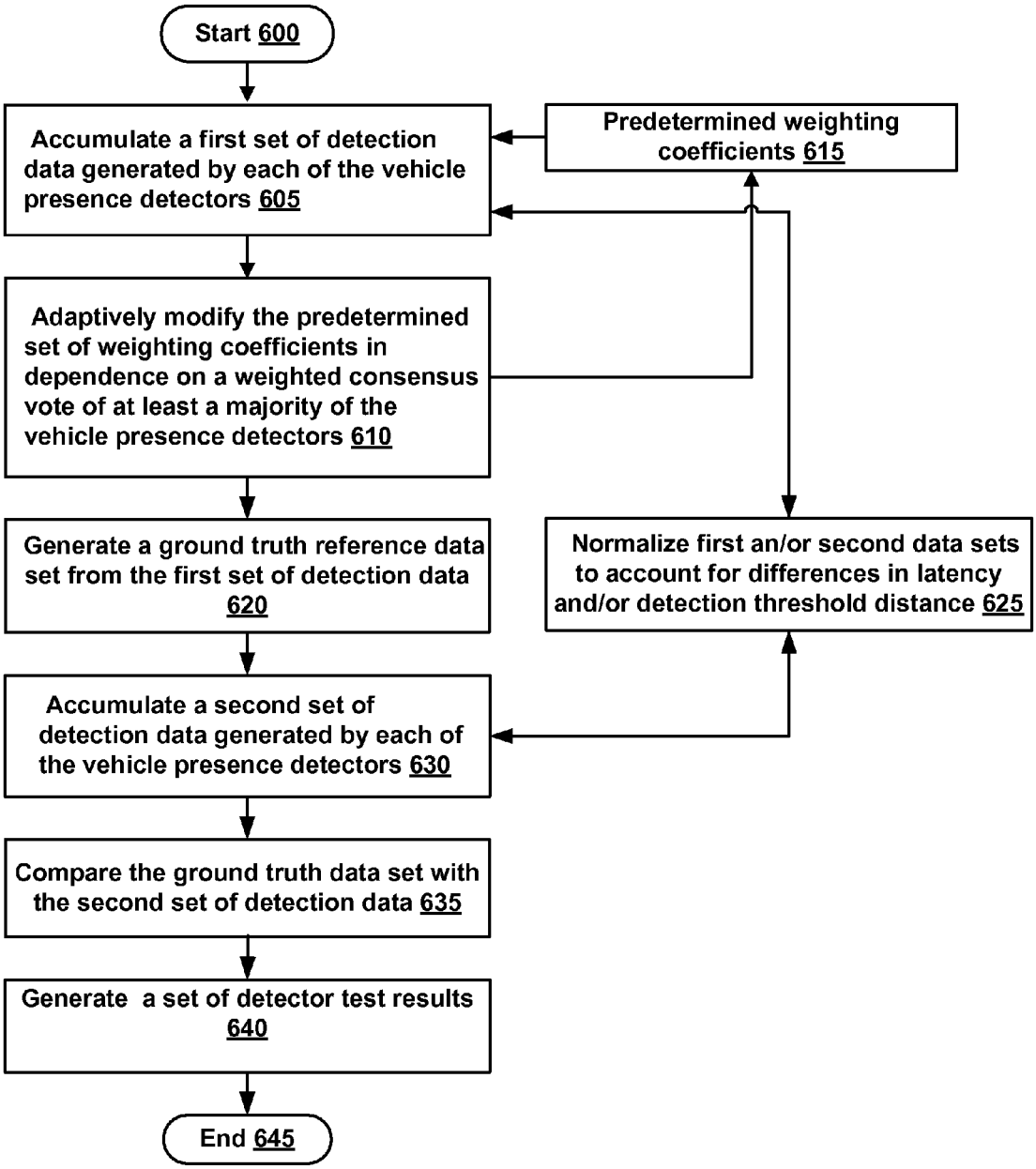
FIG. 6 is a flow chart depicting a data validation process for vehicle detector data performed by a remote client connected to a server in accordance with one embodiment.

Referring to FIG. 6, a computer implemented process which illustrates the detector performance evaluation performed by the remote client 200' is provided. The process is initiated 600 by the server 100 accumulating a first set of detection data generated by each of the vehicle presence detectors 605. Initially, the weighting coefficients 615 are predetermined by the user as described above.

As detection events are accumulated from each of the vehicle presence detectors, the predetermined set of weighting coefficients 615 are adaptively modified 610 until a sufficient number of detection events have occurred in which the weighting coefficients appear to have stabilized. After a sufficient number of detections have occurred, a weighted consensus vote of at least a majority of the vehicle presence detectors is then used to generate a ground truth reference data set from the first set of detection data 620.

Once the ground truth data 620 has been obtained, a second performance set of detection data is then accumulated from by each of the vehicle presence detectors 630. In an embodiment, either or both first and second sets of detection data 620, 630 undergoing testing are normalized to account for differences in latency and/or detection threshold distance 625. The accumulated second set of detection data is then compared with the ground truth data set 635 from which a set of detector test results are generated, thus ending the process 645.

The present inventive embodiments have been described in particular detail with respect to specific possible embodiments. Those of skill in the art will appreciate that the various inventive embodiments may be practiced in other embodiments. For instance, those of skill in the art will readily recognize that the order of operations discussed above was presented for illustrative purposes only and that other orders of operations, and combination of operations, are possible. Consequently, the order of operations discussed above does not limit the inventive embodiments as claimed.

In addition, the nomenclature used for components, capitalization of component designations and terms, the attributes, data structures, or any other programming or structural aspect is not significant, mandatory, or limiting, and the mechanisms that implement the inventive embodiments or its features can have various different names, formats, and/or protocols. Further, the apparatus and/or functionality of the various inventive embodiments may be implemented via various combinations of software and hardware, as described, or entirely in hardware elements. Also, particular divisions of functionality between the various components described herein are merely exemplary, and not mandatory or significant.

Consequently, functions performed by a single component may, in some embodiments, be performed by multiple components, and functions performed by multiple components may, in some embodiments, be performed by a single component. Some portions of the above description present the features of the inventive embodiments in terms of algorithms and symbolic representations of operations, or algorithm-like representations, of operations on information/data. These algorithmic and/or algorithm-like descriptions and representations are the means used by those of skill in the art to most effectively and efficiently convey the substance of their work to others of skill in the art. These operations, while described functionally or logically, are understood to be implemented by computer programs and/or computing systems. Furthermore, it has also proven convenient at times to refer to these arrangements of operations as steps or modules or by functional names, without loss of generality.

Unless specifically stated otherwise, as would be apparent from the above discussion, it is appreciated that throughout the above description, discussions utilizing terms such as "establishing," "defining," "requesting," "analyzing," "querying," "verifying," "providing," "obtaining," "accessing," "selecting," "listing," "determining," "storing," "reporting," "outputting," "displaying," etc., refer to the action and processes of a computing system or similar electronic device that manipulates and operates on data represented as physical (electronic) quantities within the computing system memories, registers, caches or other information storage, transmission or display devices.

Certain aspects of the inventive embodiments include process steps or operations and instructions described herein in an algorithmic and/or algorithmic-like form. It should be noted that the process steps and/or operations and instructions of the inventive embodiments can be performed using software, firmware, and/or hardware, and when embodied in software, can be downloaded to reside on and be operated from different platforms used by real time network operating systems.

The present inventive embodiments also relates to an apparatus or system for performing the operations described herein. This apparatus or system may be specifically constructed for the required purposes, or the apparatus or system can comprise a general purpose system selectively activated or configured/reconfigured by a computer program stored on a computer program product as defined herein that can be accessed by a computing system or other device.

Those having ordinary skill in the art will readily recognize that the algorithms and operations presented herein are not inherently related to any particular computing apparatus, system, computer architecture, computer or industry standard, or any other specific apparatus. Various general purpose systems may also be used with programs in accordance with the teaching herein, or it may prove more convenient/efficient to construct more specialized apparatuses to perform the required operations described herein. The required structure for a variety of these systems will be apparent to those of skill in the art, along with equivalent variations.

In addition, the present inventive embodiments are not described with reference to any particular programming language and it is appreciated that a variety of programming languages may be used to implement the teachings of inventive embodiments as described herein, and any references to a specific language or languages are provided for illustrative purposes only and for enablement of the contemplated best mode at the time of filing.

The present inventive embodiments are well suited to a wide variety of computer network systems operating over numerous topologies. Within this field, the configuration and management of large networks comprise storage devices and computers that are communicatively coupled to similar and/or dissimilar computers and storage devices over a private network, a LAN, a WAN, a private network, or a public network, such as the Internet.

It should also be noted that the language used in the specification has been principally selected for readability, clarity and instructional purposes, and may not have been selected to delineate or circumscribe the inventive subject matter. Accordingly, the disclosure of the present inventive embodiments is intended to be illustrative, but not limiting, of the inventive scope, which is set forth in the claims below.

In addition, the operations shown in the figures are shown in an exemplary order for ease of description and understanding. However, those of skill in the art will readily recognize that numerous different orders of operation could be employed. Consequently, the order of operations shown in the figures is illustrative only and does not limit the inventive scope as claimed below.

In addition, the operations shown in the figures are identified using a particular nomenclature for ease of description and understanding, but other nomenclature is often used in the art to identify equivalent operations.

Therefore, numerous variations, whether explicitly provided for by the specification or implied by the specification or not, may be implemented by one of skill in the art in view of this disclosure.

What is claimed is:

1. A computer implemented method for evaluating vehicle presence detectors comprising:

accumulating a first set of detection data generated by each of the vehicle presence detectors under test; the first set of detection data including a predetermined weighting coefficient for each of the vehicle presence detectors;

generating a ground truth reference data set from the first set of detection data by adaptively modifying the predetermined set of weighting coefficients in dependence on a weighted consensus vote of at least a majority of the vehicle presence detectors;

accumulating a second set of detection data generated by each of the vehicle presence detectors;

comparing the second set of detection data with the ground truth reference data set; and, generating a set of detector test results in dependence on the ground truth reference data set.

2. The computer implemented method according to claim 1 further including normalizing at least the first set of detection data such that each vehicle detected by the vehicle presence detectors appears within a predetermined area proximate to a normalized time.

3. The computer implemented method according to claim 2 further including obtaining a video image of each vehicle appearing within the predetermined area proximate with the normalized time.

4. The computer implemented method according to claim 2 wherein the normalization is performed for each detected vehicle using a velocity output by at least one of the vehicle presence detectors.

5. The computer implemented method according to claim 2 further including obtaining a sequence of video images of each vehicle traversing the predetermined area proximate with the normalized time.

6. The computer implemented method according to claim 5 further including determining a velocity of each vehicle traversing the predetermined area with the sequence of video images.

7. The computer implemented method according to claim 1 further including at least temporally normalizing at least the first set of detection data for differences in latency and threshold detection distance among the vehicle presence detectors.

8. The computer implemented method according to claim 1 wherein each of the vehicle presence detectors are configured to detect vehicles traversing a common lane of traffic over a common period of time and under common environmental conditions.

9. The computer implemented method according to claim 3 wherein ambiguous detection results contained in the set of detector test results are user verifiable with the obtained video image.

10. The computer implemented method according to claim 4 further including normalizing the second set of detection data such that each vehicle detected by the vehicle presence detectors appears within the predetermined area proximate to the normalized time.

11. A computing system for evaluating vehicle presence detectors comprising:

at least one processor;

a datastore coupled to the at least one processor; and, a memory coupled to the at least one processor, the memory including programmatic instructions which when executed by the at least one processor causes the at least one processor to;

accumulate a first set of detection data generated by each of the vehicle presence detectors; the first set of detection data including a predetermined weighting coefficient for each of the vehicle presence detectors;

generate a ground truth reference data set from the first set of detection data by adaptively modifying the predetermined set of weighting coefficients in dependence on a weighted consensus vote of at least a majority of the vehicle presence detectors;

accumulate a second set of detection data generated by each of the vehicle presence detectors;

compare the second set of detection data with the ground truth reference data set; and, generate a set of detector test results in dependence on the ground truth reference data set.

12. The computing system according to claim 11 further including programmatic instructions which when executed by the at least one processor, causes the at least one processor to normalize at least the first set of test detection data such that each vehicle detected by each of the vehicle presence detectors appears within a predetermined area proximate to a normalized time.

13. The computing system according to claim 12 further including programmatic instructions which when executed by the at least one processor, causes the at least one processor to obtain a video image of each vehicle appearing within the predetermined area proximate with the normalized time.

14. The computing system according to claim 12 wherein the normalization is performed for each detected vehicle using a velocity output by at least one of the vehicle presence detectors.

15. The computing system according to claim 12 further including programmatic instructions which when executed by the at least one processor, causes the at least one processor to obtain a sequence of video images of each vehicle traversing the predetermined area proximate with the normalized time.

16. The computing system according to claim 15 further including programmatic instructions which when executed by the at least one processor, causes the at least one processor to determine a velocity of each vehicle traversing the predetermined area with the sequence of video images.

17. The computing system according to claim 11 further including programmatic instructions which when executed by the at least one processor, causes the at least one processor to temporally normalize at least the first set of test detection data for differences in latency and threshold detection distance among the vehicle presence detectors.

18. The computing system according to claim 1 wherein each of the vehicle presence detectors are configured to detect vehicles traversing a common lane of traffic over a common period of time and under common environmental conditions.

19. The computing system according to claim 13 further including programmatic instructions which when executed by the at least one processor, causes the at least one processor to normalize the second set of detection data such that each vehicle detected by the vehicle presence detectors appears within a predetermined area proximate to a normalized time.

20. The computing system according to claim 14 further including programmatic instructions which when executed by the at least one processor, causes the at least one processor to normalize the second set of detection data such that each vehicle detected by the vehicle presence detectors appears within the predetermined area proximate to the normalized time.

21. A computer program product embodied on a computer readable medium comprising executable instructions which when executed by at least one processor, causes the at least one processor to;

accumulate a first set of detection data generated by a plurality vehicle presence detectors; the first set of detection data including a predetermined weighting coefficient for each of the vehicle presence detectors;

generate a ground truth reference data set from the first set of detection data by adaptively modifying the predetermined set of weighting coefficients in dependence on a weighted consensus vote of at least a majority of the vehicle presence detectors;

accumulate a second set of detection data generated by each of the vehicle presence detectors;

compare the second set of detection data with the ground truth reference data set; and, generate a set of detector test results in dependence on the ground truth reference data set.

22. The computer program product according to claim 21 further including instructions which when executed by the at least one processor, causes the at least one processor to normalize at least the first set of detection data such that each vehicle detected by each of the vehicle presence detectors appears within a predetermined area proximate to a normalized detection time.

23. The computer program product according to claim wherein the normalization is performed for each detected vehicle using a velocity output by at least one of the vehicle presence detectors.

24. The computer program product according to claim 23 further including instructions which when executed by the at least one processor, causes the at least one processor to at least temporally normalize at least the first set of detection data for differences in latency and threshold detection distance among each of the vehicle presence detectors.

25. The computer program product according to claim 22 further including programmatic instructions which when executed by the at least one processor, causes the at least one processor to obtain one or more video images of each vehicle traversing the predetermined area proximate with the normalized time.

* * * * *